US010294946B2

(12) United States Patent
Mun et al.

(10) Patent No.: US 10,294,946 B2
(45) Date of Patent: May 21, 2019

(54) AIR CONDITIONER

(71) Applicant: LG ELECTRONICS INC., Seoul (KR)

(72) Inventors: Seongkuk Mun, Seoul (KR); Sungwoo Song, Seoul (KR); Sungjin Hwang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 698 days.

(21) Appl. No.: 14/838,715

(22) Filed: Aug. 28, 2015

(65) Prior Publication Data

US 2016/0186761 A1 Jun. 30, 2016

(30) Foreign Application Priority Data

Dec. 31, 2014 (KR) ..... 10-2014-0195850

(51) Int. Cl.
*F24F 1/00* (2011.01)
*F04D 17/10* (2006.01)
(Continued)

(52) U.S. Cl.
CPC ..... *F04D 17/10* (2013.01); *F24F 1/0014* (2013.01); *F24F 1/0033* (2013.01); *F24F 13/065* (2013.01); *F24F 2001/004* (2013.01)

(58) Field of Classification Search
CPC . F04D 17/10; F24F 1/0014; F24F 1/02; F24F 1/0033; F24F 1/0025; F24F 13/065;
(Continued)

(56) References Cited

U.S. PATENT DOCUMENTS 4,958,500 A 9/1990 Kuroda et al.
2001/0031137 A1 10/2001 Jones-Lawlor et al.
2007/0129001 A1 6/2007 Orr

FOREIGN PATENT DOCUMENTS

CN 1945148 4/2007
KR 10-2003-0083185 A 10/2003
(Continued)

OTHER PUBLICATIONS

Chinese Office Action dated Jan. 18, 2017.
(Continued)

*Primary Examiner* — Mark A Laurenzi
*Assistant Examiner* — Mickey H France
(74) *Attorney, Agent, or Firm* — KED & Associates LLP

(57) ABSTRACT

The present invention includes a blower sucking and blowing air; a plurality of cylindrical air discharging units, each having an air discharging flow path through which the air blown by the blower passes and discharges, the plurality of air discharging units respectively having rotational center axes parallel with each other; and an air discharging unit rotating mechanism rotating each of the plurality of air discharging units, with the respective rotational center axes of the air discharging units kept in position. The plurality of air discharging units arranged in parallel with each other may distributively discharge air in multiple directions. A distributed air discharge mode in which the plurality of air discharging units discharge air in different directions and a front intensive air discharge mode in which the plurality of air discharging units discharge air in a front direction may be chosen by the user, responding to the user's demand that the air flow be concentrated in the front direction while enabling efficient indoor air conditioning.

19 Claims, 11 Drawing Sheets

(51) Int. Cl.
*F24F 13/065* (2006.01)
*F24F 1/0014* (2019.01)
*F24F 1/0033* (2019.01)

(58) Field of Classification Search
CPC ..... F24F 13/0604; F24F 13/20; F24F 13/08; F24F 13/06; F24F 2001/004; F24F 2001/0048
USPC ..... 415/203; 62/89, 263, 412
See application file for complete search history.

(56) References Cited

FOREIGN PATENT DOCUMENTS

| | | |
|---|---|---|
| KR | 10-2008-0013393 A | 2/2008 |
| KR | 10-2009-0017289 | 2/2009 |
| KR | 10-1500506 | 3/2015 |
| WO | WO 2007/136202 | 11/2007 |

OTHER PUBLICATIONS

European Search Report dated May 2, 2016.
Korean Notice of Allowance issued in Application No. 10-2014-0195850 dated Apr. 20, 2015.

AIR CONDITIONER

CROSS-REFERENCE TO RELATED PATENT APPLICATIONS

This application claims priority under 35 U.S.C. § 119 to Korean Patent Application No. 10-2014-0195850, filed on Dec. 31, 2014 in the Korean Intellectual Property Office, whose entire disclosure is incorporated herein by reference.

BACKGROUND

1. Field of the Invention

The present invention concerns air conditioners, and particularly, to air conditioners having an air discharging unit for discharging air to the outside.

2. Description of the Related Art

Air conditioners are devices that suck in air, change the temperature, humidity, or cleanness of the air, and then discharges the air to the outside.

An air conditioner may include a cooler or heater for changing indoor temperature, a humidifier or dehumidifier for changing indoor humidity, and an air purifier for changing indoor air cleanness.

An air conditioner may include an air conditioning unit for changing the temperature, humidity, or cleanness of the air and a blower for blowing the air into the air conditioning unit.

The air conditioning unit may be a heat exchanger or a filter.

An air conditioner may have an air discharging body such as a header or a diffuser. The air may be changed for at least one of its temperature, humidity, and cleanness inside the air conditioner and may be then discharged via the air discharging body to the outside.

The air discharging body may be elevatably or rotatably installed at an upper portion of the air conditioner.

SUMMARY OF THE INVENTION

The present invention aims to provide an air conditioner that has a plurality of cylindrical air discharging units for guiding indoor air in multiple directions.

According to the present invention, an air conditioner comprises: a blower sucking and blowing air; a plurality of cylindrical air discharging units, each having an air discharging flow path through which the air blown by the blower passes and discharges, the plurality of air discharging units respectively having rotational center axes parallel with each other; and an air discharging unit rotating mechanism rotating each of the plurality of air discharging units, with the respective rotational center axes of the air discharging units kept in position.

The blower may include a first air discharging part blowing air to any one of the plurality of air discharging units and a second air discharging part blowing air to the other of the plurality of air discharging units.

The air discharging unit rotating mechanism may include a first gear disposed in any one of the plurality of air discharging units; a first gear rotating mechanism rotating the first gear; a second gear disposed in another of the plurality of air discharging units; and a second gear rotating mechanism rotating the second gear.

The air discharging unit rotating mechanism may include a lower body rotatably supporting a lower portion of a corresponding one of the plurality of air discharging units.

The air discharging unit rotating mechanism may further include a lower cover, and the lower cover may include a first gear rotating mechanism mounting part where the first gear rotating mechanism is mounted and a second gear rotating mechanism mounting part where the second gear rotating mechanism is mounted.

The lower cover may include a plurality of couplers coupled with the blower.

The air discharging unit rotating mechanism may include a lower body rotatably supporting a lower portion of each of the plurality of air discharging units; and a rear body disposed perpendicular to the lower body and rotatably accommodating the plurality of air discharging units.

The rear body may include a first accommodating part having a recessed surface facing a first air discharging unit among the plurality of air discharging units to rotatably accommodate the first air discharging unit; and a second accommodating part having a recessed surface facing a second air discharging unit among the plurality of air discharging units to rotatably accommodate the second air discharging unit.

The air discharging unit rotating mechanism may further include a top cover coupled to the rear body and positioned at an upper side of the plurality of air discharging units.

The top cover may include an axis supporting part rotatably supporting the rotational center axis of a corresponding one of the plurality of air discharging units.

The air conditioner may further include a center body positioned long in upper and lower directions between the plurality of air discharging units to cover a gap between the plurality of air discharging units.

The air discharging unit rotating mechanism may include a lower body rotatably supporting a lower portion of a corresponding one of the plurality of air discharging units.

The center body may be disposed at an upper side of the lower body.

The air discharging unit rotating mechanism may further include a first air discharging unit rotating mechanism rotating the first air discharging unit among the plurality of air discharging units so that the air discharging flow path of the first air discharging unit is opened to an outside when the air conditioner operates and rotating the first air discharging unit so that at least a portion of the air discharging flow path of the first air discharging unit faces the center body when the air conditioner stops; and a second air discharging unit rotating mechanism rotating the second air discharging unit among the plurality of air discharging units so that the air discharging flow path of the second air discharging unit is opened to the outside when the air conditioner operates and rotating the second air discharging unit so that at least a portion of the air discharging flow path of the second air discharging unit faces the center body when the air conditioner stops.

The air discharging unit rotating mechanism may further include a rear body formed perpendicular to the lower body and rotatably accommodating a corresponding one of the plurality of air discharging units.

The rear body may include a first accommodating part having a recessed surface facing a first air discharging unit among the plurality of air discharging units to rotatably accommodate the first air discharging unit; and a second accommodating part having a recessed surface facing a second air discharging unit among the plurality of air discharging units to rotatably accommodate the second air discharging unit.

The first air discharging unit may have a first air outlet at a periphery thereof, and the second air discharging unit has a second air outlet at a periphery thereof. A left-right width of the first air outlet may be smaller than a width between a left side end of the first accommodating part and the center body, and a left-right width of the second air outlet may be smaller than a width between a right side end of the second accommodating part and the center body.

The rear body may have a center body coupler to which the center body is coupled. The center body coupler may project in a front direction.

The center body coupler may project between the plurality of air discharging units.

The center body and the center body coupler may partition, left and right, an upper side of the lower body.

The center body may include a center case with a left side surface facing any one of the plurality of air discharging units, a right side surface facing the other of the plurality of air discharging units, and an opened front surface; a center cover disposed before the center case; and a PCB assembly provided in the center case to radiate light to the center cover.

The air discharging unit rotating mechanism may include a center body coupler projecting to a space between the plurality of air discharging units.

The center case may be coupled to the center body coupler. The left-right width of the center case may increase in the front direction thereof.

A left-right width of the center cover may be larger than a left-right width of an end of the center body coupler.

According to the present invention, an air conditioner comprises: a blower sucking and blowing air; a plurality of cylindrical air discharging units, each having an air discharging flow path through which the air blown by the blower passes and discharges; and an air discharging unit holder keeping the plurality of air discharging units in parallel with each other.

The blower may include a first air discharging part blowing air to any one of the plurality of air discharging units and a second air discharging part blowing air to the other of the plurality of air discharging units.

The left side surface, right side surface, and front surface of the air discharging unit holder may be opened.

The air discharging unit holder may include a lower body supporting a lower portion of each of the plurality of air discharging units.

The air discharging unit holder may further include a rear body formed perpendicular to the lower body and accommodating a corresponding one of the plurality of air discharging units.

The rear body may include a first accommodating part having a recessed surface facing a first air discharging unit among the plurality of air discharging units to rotatably accommodate the first air discharging unit; and a second accommodating part having a recessed surface facing a second air discharging unit among the plurality of air discharging units to rotatably accommodate the second air discharging unit.

The air discharging unit holder may further include a top cover coupled to the rear body and positioned at an upper side of the plurality of air discharging units.

The top cover may have an air discharging unit supporting part supporting the air discharging units.

The air conditioner may further include a center body positioned long in upper and lower directions between the plurality of air discharging units to cover a gap between the plurality of air discharging units.

The air discharging unit holder may include a lower body supporting a lower portion of each of the plurality of air discharging units, and the center body may be disposed at an upper side of the lower body.

The air discharging unit holder may further include a rear body formed perpendicular to the lower body and accommodating a corresponding one of the plurality of air discharging units.

The rear body may have a center body coupler to which the center body is coupled. The center body coupler may project in a front direction.

The center body coupler may project between the plurality of air discharging units.

The center body and the center body coupler may partition, left and right, an upper side of the lower body.

The center body may include a center case with a left side surface facing any one of the plurality of air discharging units, a right side surface facing the other of the plurality of air discharging units, and an opened front surface; a center cover disposed before the center case; and a PCB assembly provided in the center case to radiate light to the center cover.

The center case may be coupled to the center body coupler. The left-right width of the center case may increase in the front direction thereof.

According to the present invention, the plurality of air discharging units arranged in parallel with each other may distribute and discharge air in multiple directions.

According to the present invention, a distributed air discharge mode in which the plurality of air discharging units discharge air in different directions and a front intensive air discharge mode in which the plurality of air discharging units discharge air in a front direction may be chosen by the user, responding to the user's demand that the air flow be evenly distributed over the entire room or be concentrated in the front direction while enabling efficient indoor air conditioning.

The plurality of air discharging units may be stably supported without overturn.

The gap between the plurality of air discharging units is covered, thus preventing any accident that may occur when the user puts his hand or something else in the gap while minimizing inflow of foreign materials between the plurality of air discharging units.

Further, when the air conditioner stops, the air discharging flow paths of the air discharging units may be shielded, which eliminates the need of a separate door for covering the air discharging flow paths. Accordingly, the air discharging flow paths of the air discharging units may remain clean with a simple configuration.

BRIEF DESCRIPTION OF THE DRAWINGS

Features and advantages of the present invention may be better understood from the following description of embodiments thereof taken in conjunction with the accompanying drawings, wherein.

DETAILED DESCRIPTION

Hereinafter, embodiments of the present invention are described in detail with reference to the accompanying drawings.

Figure 1:
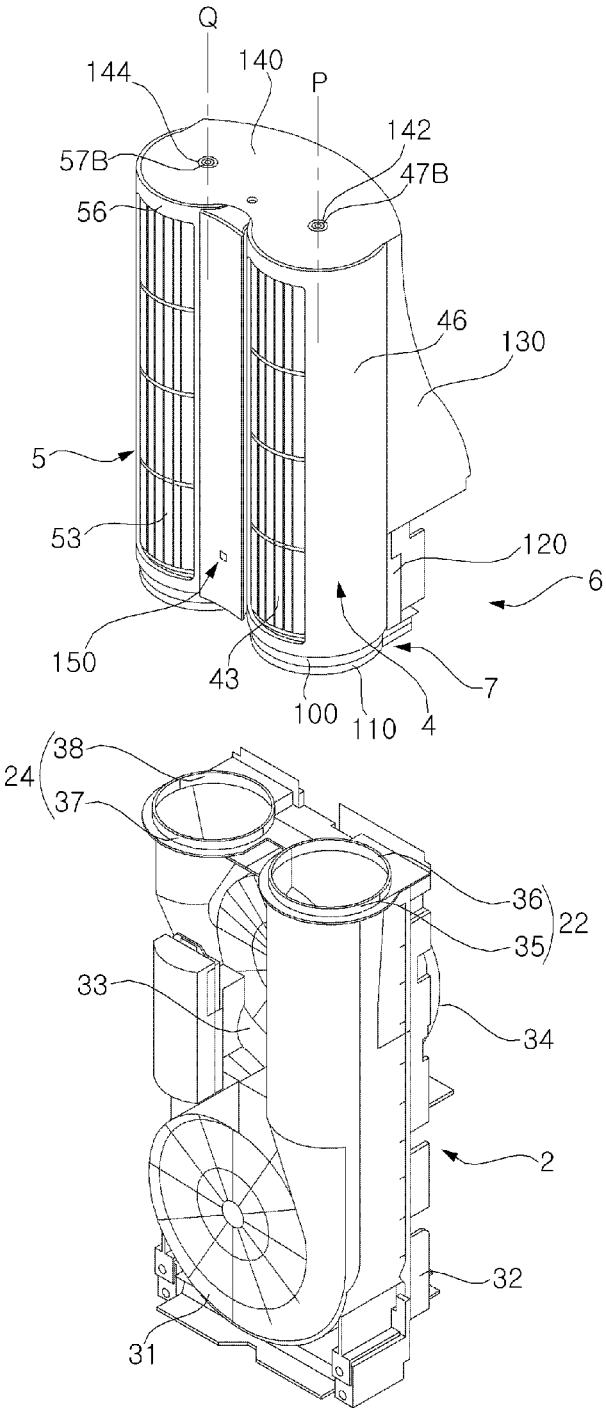
FIG. 1 is an exploded perspective view illustrating an air discharging unit and a blower of an air conditioner according to an embodiment of the present invention.
Figure 2:
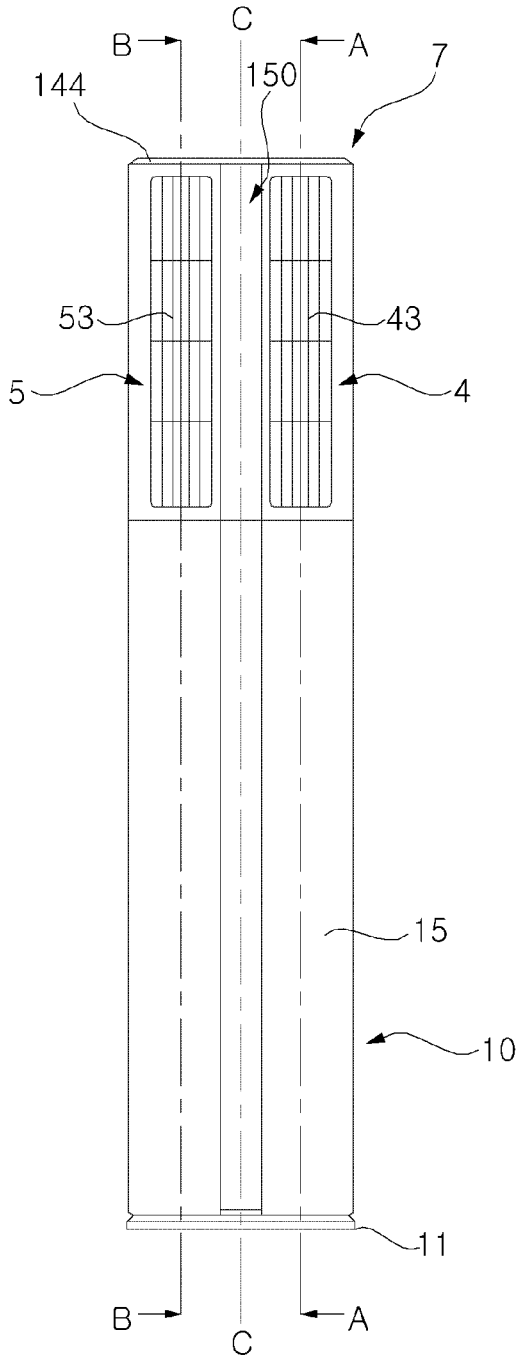
FIG. 2 is a front view illustrating an air conditioner according to an embodiment of the present invention.
Figure 3:
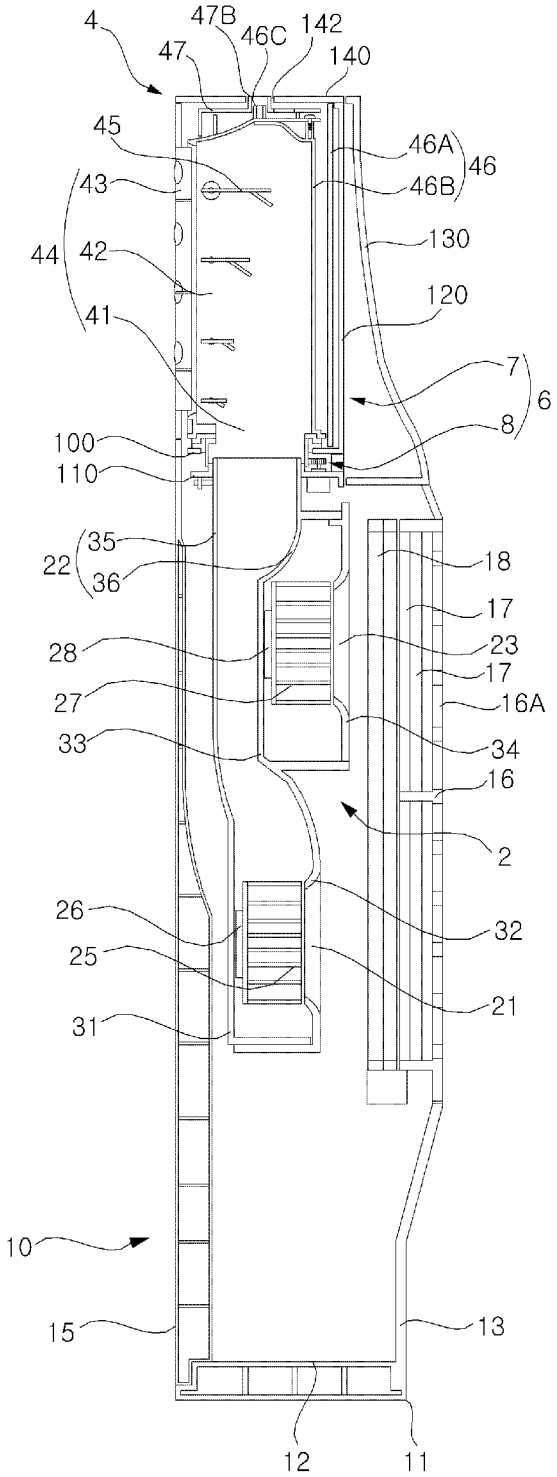
FIG. 3 is a cross-sectional view taken along line A-A of FIG. 2.
Figure 4:
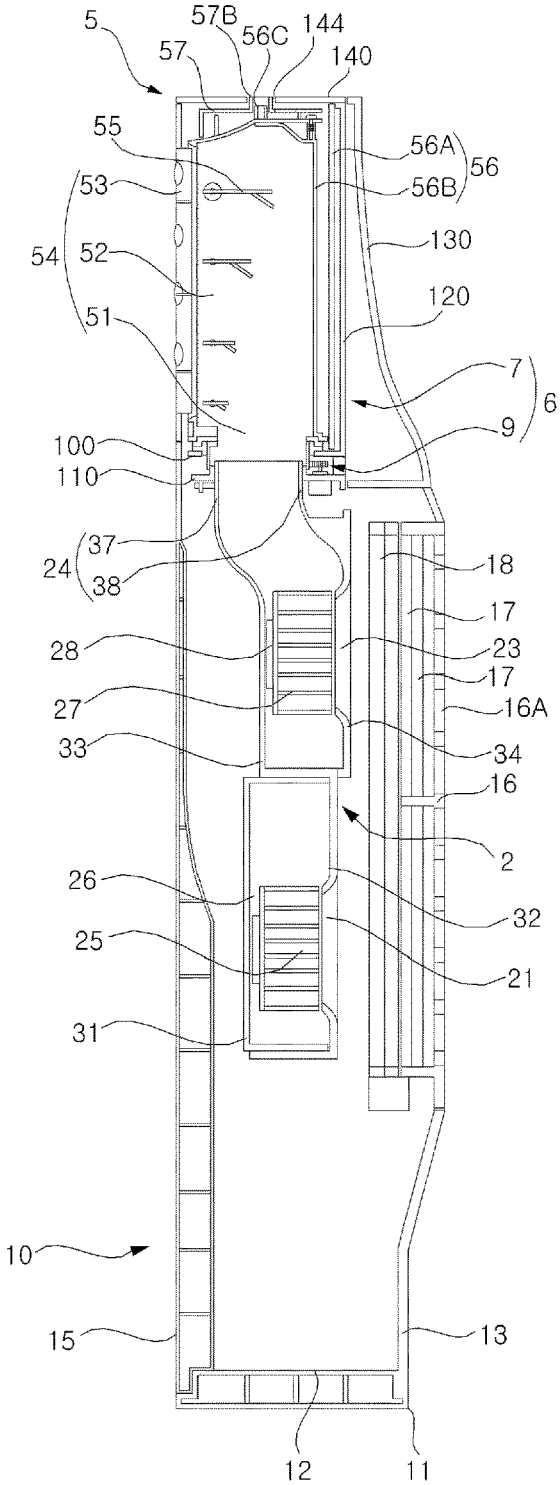
FIG. 4 is a cross-sectional view taken along line B-B of FIG. 2.
Figure 5:
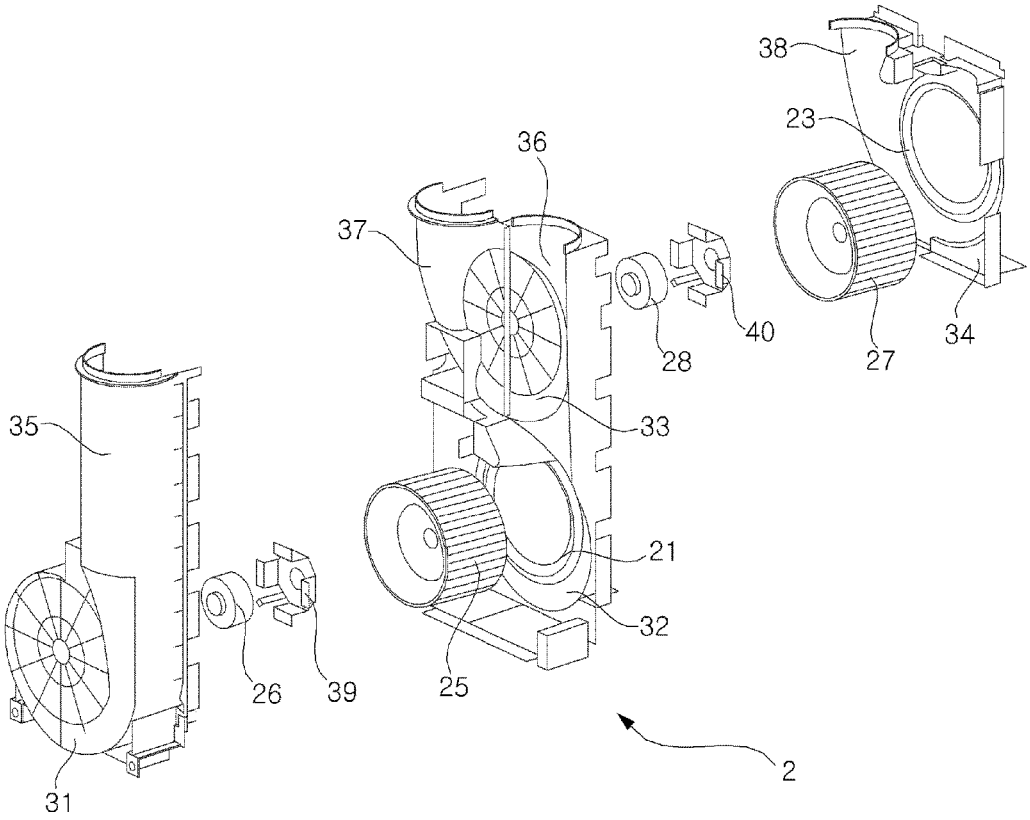
FIG. 5 is an exploded perspective view illustrating the blower shown in FIG. 1.

FIG. 1 is an exploded perspective view illustrating an air discharging unit and a blower of an air conditioner according to an embodiment of the present invention. FIG. 2 is a front view illustrating an air conditioner according to an embodiment of the present invention. FIG. 3 is a cross-sectional view taken along line A-A of FIG. 2. FIG. 4 is a cross-sectional view taken along line B-B of FIG. 2. FIG. 5 is an exploded perspective view illustrating the blower shown in FIG. 1.

The air conditioner includes a blower 2 and a plurality of cylindrical air discharging units 4 and 5 each having an air discharging flow path through which the air blown by the blower 2 passes and discharges.

The plurality of air discharging units 4 and 5 may be disposed to have rotational center axes P and Q parallel with each other. The air conditioner includes an air discharging unit rotating mechanism 6 for rotating the plurality of air discharging units 4 and 5. The air discharging unit rotating mechanism 6 may rotate the plurality of air discharging units 4 and 5, with the respective rotational center axes P and Q of the air discharging units 4 and 5 maintaining their respective positions. The plurality of air discharging units 4 and 5 may be left by the air discharging unit rotating mechanism 6 to keep their respective rotational center axes P and Q in parallel with each other. The air conditioner includes an air discharging unit holder 7 for keeping the plurality of air discharging units 4 and 5 in parallel with each other. The air discharging unit holder 7 may constitute a portion of the air discharging unit rotating mechanism 6. The air discharging unit rotating mechanism 7 may keep the respective rotational center axes P and Q of the air discharging units 4 and 5 maintaining their respective positions. Each of the air discharging units 4 and 5 may be left in position by the air discharging unit holder 7, and the respective rotational center axes P and Q of the air discharging units 4 and 5 may remain in position by the air discharging unit holder 7.

The air conditioner may include a casing 10 forming the outer appearance as shown in FIGS. 2 to 4.

The casing 10 may include a base 11. The base 11 may have a stereoscopic shape with its front and top surfaces opened. The base 11 may include a lower frame 12 and a rear plate part 13 formed on the lower frame 12. The rear plate part 13 may be vertically formed at a rear portion of the lower frame 12.

The casing 10 may further include a front cover 15. The front cover 15 may be provided to cover the front side of the blower 2. The bottom of the front cover 15 may be mounted on the lower frame 12 of the base 11. The front cover 15 may be provided at the lower frame 12 to shield a portion of the lower frame 12.

The casing 10 may include a sucking body 16 through which air is sucked into the inside of the air conditioner. The sucking body 16 may be provided at the top of the base 11. The sucking body 16 may be provided at the top of the rear plate part 13 of the base 11. The sucking body 16 may be provided long in upper and lower directions at the top of the rear plate part 13 of the base 11. The sucking body 16 may include an air inlet 16A through which air is sucked from outside of the air conditioner into the inside of the air conditioner. The sucking body 16 may include a purifying unit 17 for purifying the air sucked into the air conditioner. The purifying unit 17 may include a filter for filtering foreign bodies from the air passing therethrough. The purifying unit 17 may include an electric dust collector that attracts and collects dust from air by electrification. The purifying unit 17 may include an ion generator for generating ions in the air.

The air conditioner may include a heat exchanger 18 provided inside the casing 10 to exchange heat between the air and a coolant. The heat exchanger 18 may be positioned between the sucking body 16 and the blower 2 in an air flowing direction.

Air may be sucked from outside the air conditioner through the sucking body 16 to the inside of the air conditioner, and the air may then pass through the heat exchanger 18. After passing through the heat exchanger 18, the air may be sucked into the blower 2 and may be then blown by the blower 2 to the plurality of air discharging units 4 and 5.

Of the air having passed through the heat exchanger 18, a portion may be blown by one of the plurality of air discharging units 4 and 5 and the remainder by the other of the plurality of air discharging units 4 and 5. The air may be distributed by the blower 2 into the plurality of air discharging units 4 and 5, and the distributed air may be distributively discharged into the room through the plurality of air discharging units 4 and 5.

The blower 2 may be installed inside the casing 10. The blower 2 may be installed opposite a portion of the heat exchanger 18. The blower 2 may be positioned at a front side of the heat exchanger 18. The blower 2 may suck air from a rear side thereof and blow the air in an upper direction.

The blower 2 includes a first air discharging part 22 for blowing air to the air discharging flow path 44 of one 4 of the plurality of air discharging units 4 and 5 and a second air discharging part 24 for blowing the air to the air discharging flow path 54 of the other 5 of the plurality of air discharging units 4 and 5. The blower 2 may distributively discharge the air sucked through a sucking part to the first air discharging part 22 and the second air discharging part 24. The blower 2 may include a plurality of sucking parts 21 and 23. The blower 2 may suck air through the first sucking part 21 of the plurality of sucking parts 21 and 23 and then blow the air to the first air discharging part 22 or may suck air through the second sucking part 23 of the plurality of sucking parts 21 and 23 and then blow the air to the second air discharging part 24. In the case of having the plurality of sucking parts 21 and 23, the blower 2 may include a first air blowing flow path through which the air sucked through the first sucking part 21 is discharged to the second air discharging part 22 and a second air blowing flow path through which the air sucked through the second sucking part 23 is discharged to the second air discharging part 24. In the case of having the plurality of sucking parts 21 and 23, the blower 2 may include a first blower 25 rotated in the first air blowing flow path and a first fan motor 26 for rotating the first blower 25, and the blower 2 may further include a second blower 27 rotated in the second air blowing flow path and a second fan motor 28 for rotating the second blower 27.

The blower 2 may include a first fan housing 31 having the first fan motor 26 mounted therein and surrounding the first blower 25 and a first orifice 32 coupled with the first fan housing 31 and having the first sucking part 21 for guiding air to the first blower 25.

The first fan motor 26 may be mounted in the first fan housing 31 by a first fan motor mounter 39.

The blower 2 may include a second fan housing 33 having the second fan motor 28 mounted therein and surrounding the second blower 27 and a second orifice 34 coupled with the second fan housing 33 and having the second sucking part 23 for guiding air to the second blower 27.

The second fan motor 28 may be mounted in the second fan housing 33 by a second fan motor mounter 40.

The second fan housing 33 may be formed at an upper side of the first orifice 32 integrally with the first orifice 32. The second orifice 34 may be coupled with the second fan housing 33 at a rear side of the second fan housing 33, and the first fan housing 31 may be coupled with the first orifice 32 at a front side of the first orifice 32.

The first air discharging part 22 may be formed by the first fan housing 31 and the second fan housing 33 as shown in FIG. 3. The first fan housing 31 may include a first front duct part 35 with an opened rear surface, which projects in an upper direction and is disposed at a front side of a portion of the second fan housing 33. The second fan housing 31 may include a first rear duct part 36 that is positioned at a rear side of the first front duct part 35 and is recessed in a rear direction. The first front duct part 35 and the first rear duct part 36 may guide the air blown by the first blower 25 to the first air discharging unit 4. When the first fan housing 31 and the second fan housing 33 are coupled with each other so that the first front duct part 35 is positioned at a front side of the first rear duct part 36, the first front duct part 35 and the first rear duct part 36 may constitute a duct unit shaped as a hollow cylinder.

The second air discharging part 24 may be formed by the second fan housing 33 and the second orifice 34 as shown in FIG. 4. The second fan housing 31 may have a second front duct part 37 with an opened rear surface, which projects in a front direction and positions itself at a front side of a portion of the second orifice 34. The second orifice 34 may include a second rear duct part 38 that is positioned at a rear side of the second front duct part 37 and is recessed in a rear direction. The second front duct part 37 and the second rear duct part 38 may guide the air blown by the second blower 27 to the second air discharging unit 5. When the second fan housing 33 and the second orifice 34 are coupled with each other so that the second front duct part 37 is positioned at a front side of the second rear duct part 38, the second front duct part 37 and the second rear duct part 38 may constitute a duct unit shaped as a hollow cylinder.

The plurality of air discharging units 4 and 5 may guide the air blown by the blower 2 to the outside. The plurality of air discharging units 4 and 5 may distributively discharge the air coming from the blower 2 to the outside, with the air discharging units 4 and 5 disposed in parallel with each other. The plurality of air discharging units 4 and 5 may be spaced apart from each other in a horizontal direction. A gap may be present between the plurality of air discharging units 4 and 5. Two, three, or more air discharging units 4 and 5 may be provided. The plurality of air discharging units 4 and 5 may have the same structure but different positions.

The plurality of air discharging units 4 and 5, each, may have an inlet through which the air blown by the blower 2 passes into the inside thereof. The plurality of air discharging units 4 and 5, each, may have an internal flow path that guides the air introduced through the inlet. The plurality of air discharging units 4 and 5, each, may have an air outlet through which the air passing through the internal flow path is discharged to the outside of the air conditioner. The air inlet, the internal flow path, and the air outlet may form the air discharging flow path of the air discharging unit 4 and 5. The air blown by the blower 2 may flow through the inlet into the internal flow path, and the air may be then discharged through the internal flow path to the outside.

In case two air discharging units 4 and 5 are provided, the plurality of air discharging units 4 and 5 may include a first air discharging unit 4 and a second air discharging unit 5. In this case, the first air discharging unit 4 and the second air discharging unit 5, respectively, may be installed left and right with respect to the central line C of the air conditioner. One of the first air discharging unit 4 and the second air discharging unit 5 may be a left air discharging unit that is positioned at a left side of the central line C of the air conditioner. The other of the first air discharging unit 4 and the second air discharging unit 5 may be a right air discharging unit that is positioned at a right side of the central line C of the air conditioner. The left air discharging unit may discharge air from the left side of the air conditioner to the front side of the air conditioner, and the right air discharging unit may discharge air from the right side of the air conditioner to the front side of the air conditioner.

The first air discharging unit 4 and the second air discharging unit 5 may discharge air in opposite directions thereof. The first air discharging unit 4 may discharge air in a left direction of the air conditioner, and in this case, the second air discharging unit 5 may discharge air in a right direction of the air conditioner.

The first air discharging unit 4 may discharge air in a first inclined direction that is a left and front direction of the air conditioner, and the second air discharging unit 5 may discharge air in a second inclined direction that is a right and front direction of the air conditioner.

The first air discharging unit 4 may discharge air in a front direction of the air conditioner, and the second air discharging unit 5 may discharge air in the front direction of the air conditioner. In this case, the first air discharging unit 4 and the second air discharging unit 5 may discharge air in directions parallel with each other, and two front air flows may be created at a front side of the air conditioner.

Of the plurality of air discharging units 4 and 5, the first air discharging unit 4 may include a first air inlet 41 through which the air blown by the blower 2 is introduced, a first internal flow path 42 for guiding the air having passed through the first air inlet 41, and a first air outlet 43 through which the air guided by the first internal flow path 42 is discharged to the outside. The first air inlet 41, the first internal flow path 42, and the first air outlet 43 may constitute the first air discharging flow path 44 of the first air discharging unit 4.

A first wind direction adjusting vane 45 may be disposed in the first air discharging unit 4 to adjust the direction of air passing through the first air discharging flow path 44. The first wind direction adjusting vane 45 may be rotatably disposed inside the first air discharging unit 4. The first wind direction adjusting vane 45 may be positioned at the first internal flow path 42, with its tip facing the first air outlet 43.

The first air inlet 41 may be formed at a lower portion of the first air discharging unit 4 to pass therethrough in upper and lower directions. The first internal flow path 42 may be formed long in upper and lower directions inside the first air discharging unit 4. The first air outlet 43 may be formed at an outer circumferential portion of the first air discharging unit 4. The first air discharging unit 4 may be shaped so that its upper surface is closed, and the first air outlet 43 may be formed at the outer circumferential portion of the first air discharging unit 4 among a top plate part and the outer circumferential portion of the first air discharging unit 4. The first air outlet 43 may be formed at the outer circumferential portion of the first air discharging unit 4 to pass therethrough in a horizontal direction. The first air outlet 43 may be formed long in upper and lower directions of the first air discharging unit 4 at the outer circumferential portion of the first air discharging unit 4. The opened direction of the first air inlet 41 may be perpendicular with the opened direction of the first air outlet 43. After flowing through the first air inlet 41 to the inside of the first air discharging unit 4, the air changes its flow direction, and may be discharged through the first air outlet 43 in a horizontal direction.

Of the plurality of air discharging units 4 and 5, the second air discharging unit 5 may include a second air inlet 51 through which the air blown by the blower 2 is introduced, a second internal flow path 52 for guiding the air having passed through the second air inlet 51, and a second air outlet 53 through which the air guided by the second internal flow path 52 is discharged to the outside. The second air inlet 51, the second internal flow path 52, and the second air outlet 53 may constitute the second air discharging flow path 54 of the second air discharging unit 5.

A second wind direction adjusting vane 55 may be disposed in the second air discharging unit 5 to adjust the direction of air passing through the second air discharging flow path 54. The second wind direction adjusting vane 55 may be rotatably disposed inside the second air discharging unit 5. The second wind direction adjusting vane 55 may be positioned at the second internal flow path 52, with its tip facing the second air outlet 53.

The second air inlet 51 may be formed at a lower portion of the second air discharging unit 5 to pass therethrough in upper and lower directions. The second internal flow path 52 may be formed long in upper and lower directions inside the second air discharging unit 5. The second air outlet 53 may be formed at an outer circumferential portion of the second air discharging unit 5. The second air discharging unit 5 may be shaped so that its upper surface is closed, and the second air outlet 53 may be formed at the outer circumferential portion of the second air discharging unit 5 among a top plate part and the outer circumferential portion of the second air discharging unit 5. The second air outlet 53 may be formed at the outer circumferential portion of the second air discharging unit 5 to pass therethrough in a horizontal direction. The second air outlet 53 may be formed long in upper and lower directions of the second air discharging unit 5 at the outer circumferential portion of the second air discharging unit 5. The opened direction of the second air inlet 51 may be perpendicular with the opened direction of the second air outlet 53. After flowing through the second air inlet 51 to the inside of the second air discharging unit 5, the air changes its flow direction, and may be discharged through the second air outlet 53 in a horizontal direction.

The air discharging unit rotating mechanism 6 may include a lower body 100 for supporting each of the plurality of air discharging units 4 and 5. The lower body 100 may rotatably support each of the plurality of air discharging units 4 and 5. The air discharging unit holder 7 may include the lower body 100. The plurality of air discharging units 4 and 5 may be seated on the lower body 100, spaced apart from the lower body 100, and the load of the plurality of air discharging units 4 and 5 may be distributed on the lower body 100. The lower body 100 may be a portion of the air discharging unit holder 7. The lower body 100 may form a lower portion of the air discharging unit holder 7.

The air discharging unit rotating mechanism 6 may further include a lower cover 110 installed in the lower body 100. The lower cover 110 may be coupled at an upper portion of the blower 2, and the lower cover 110 may mount the air discharging unit rotating mechanism 6 to the blower 2. The lower cover 110, together with the lower body 100, may constitute the air discharging unit holder 7. The lower cover 110 may function as an air discharging unit holder mounter for mounting the air discharging unit holder 7 to the blower 2.

The air discharging unit rotating mechanism 6 may further include a rear body 120 that is formed to be perpendicular with the lower body 100 and accommodates the plurality of air discharging units 4 and 5. The rear body 120 may be formed perpendicular with the lower body 100 and may rotatably accommodate the plurality of air discharging units 4 and 5. The rear body 120 may be integrally formed with the lower body 100 at a rear side of the lower body 100. The rear body 120 may be formed separately from the lower body 100 and may be coupled with a rear portion of the lower body by way of a connecting member such as screws or hooks. The rear body 120, together with the lower body 100, may constitute the air discharging unit holder 7. The rear body 120 may be formed to be larger in size than the gap between the plurality of air discharging units 4 and 5. The rear body 120 may shield the gap between the plurality of air discharging units 4 and 5 at a rear side of the plurality of air discharging units 4 and 5. The left-right width of the lower body 100 may be smaller than the width between a left side end of the first air discharging unit 4 and a right side end of the second air discharging unit 5.

The air discharging unit rotating mechanism 6 may further include a top cover 140 that is coupled with the rear body 120 and that is positioned at an upper side of the plurality of air discharging units 4 and 5. The top cover 140, together with the rear body 120 and the lower body 100, may constitute the air discharging unit holder 7. The top cover 140 may keep an upper portion of the plurality of air discharging units 4 and 5 in position. The top cover 140 may have an air discharging unit position maintaining part for keeping the plurality of air discharging units 4 and 5 in position. The top cover 140 may have axis supporting parts 142 and 144 for rotatably supporting the rotational center axes of the plurality of air discharging units 4 and 5. The axis supporting parts may function as air discharging unit position maintaining parts. The number of axis supporting parts 142 and 144 may be the same as the number of air discharging units 4 and 5. In case the plurality of air discharging units 4 and 5 include the first air discharging unit 4 and the second air discharging unit 5, the axis supporting parts 142 and 144 may include a first axis supporting part 142 for rotatably supporting the rotational center axis of the first air discharging unit 4 and a second axis supporting part 144 for rotatably supporting the rotational center axis of the second air discharging unit 5.

In case the air discharging unit holder 7 includes all of the lower body 100, the rear body 120, and the top cover 140, the overall air discharging unit holder 7 may be positioned at rear and upper sides of the air discharging units 4 and 5. The air discharging unit holder 7 may be shaped substantially as the letter "L" to surround the rear and upper sides of the air discharging units 4 and 5.

The air conditioner may further include a center body 150 that is positioned long in upper and lower directions between the plurality of air discharging units 4 and 5 to cover the gap between the plurality of air discharging units 4 and 5. The center body 150 may be positioned at an upper side of the lower body 100. A portion of the center body 150 may be positioned at a lower side of the top cover 140, and the center body 150 may shield the gap between the plurality of air discharging units 4 and 5 between the lower body 100 and the top cover 140.

The air discharging unit rotating mechanism 6 may open a left side surface and a right side surface, each. The air discharging unit holder 7 may form the outer appearance of the air discharging unit rotating mechanism 6, and the air discharging unit holder 7 may be shaped so that the left side surface, right side surface, and front surface thereof are opened.

The air discharging unit holder 7 may play a role as a sort of frame that keeps the plurality of air discharging units 4 and 5 in parallel with each other, and the plurality of air discharging units 4 and 5 may be positioned left and right about the air discharging unit holder 7 to be spaced apart from each other.

The center body 150 may be installed in the air discharging unit holder 7 to partition the air discharging unit holder 7 left and right. In the air conditioner configured so, the space between the left side of the center body 150 and the left side end of the rear body 120 may be opened, and the space between the right side of the center body 150 and the right side end of the rear body 120 may be opened. The first air discharging unit 4 may be installed to be partially positioned between the left side of the center body 150 and the left side end of the rear body 120. The second air discharging unit 5 may be installed to be partially positioned between the right side of the center body 150 and the right side end of the rear body 120. The first air discharging unit 4 and the second air discharging unit 5 may be protected by the center body 150 and the air discharging unit holder 7.

The center body 150 may be formed separately from the lower body 100, the rear body 120, and the top cover 140, and may be coupled with at least one of the lower body 100, the rear body 120, and the top cover 140. The center body 150 may be integrally formed with at least one of the lower body 100, the rear body 120, and the top cover 140, and in such case, the center body 150 may be part of the air discharging unit holder 7.

The center body 150 may be positioned at a front side of the air discharging unit holder 7 among the front side and a rear side of the air discharging unit holder 7, and the center body 150 may be positioned at the front and center of the air discharging unit holder 7, among the front and left side, the front and center, and the front and right side of the air discharging unit holder 7. The air discharging unit holder 7 may be opened for its left side surface, right side surface, front and left side, and front and right side.

Figure 6:
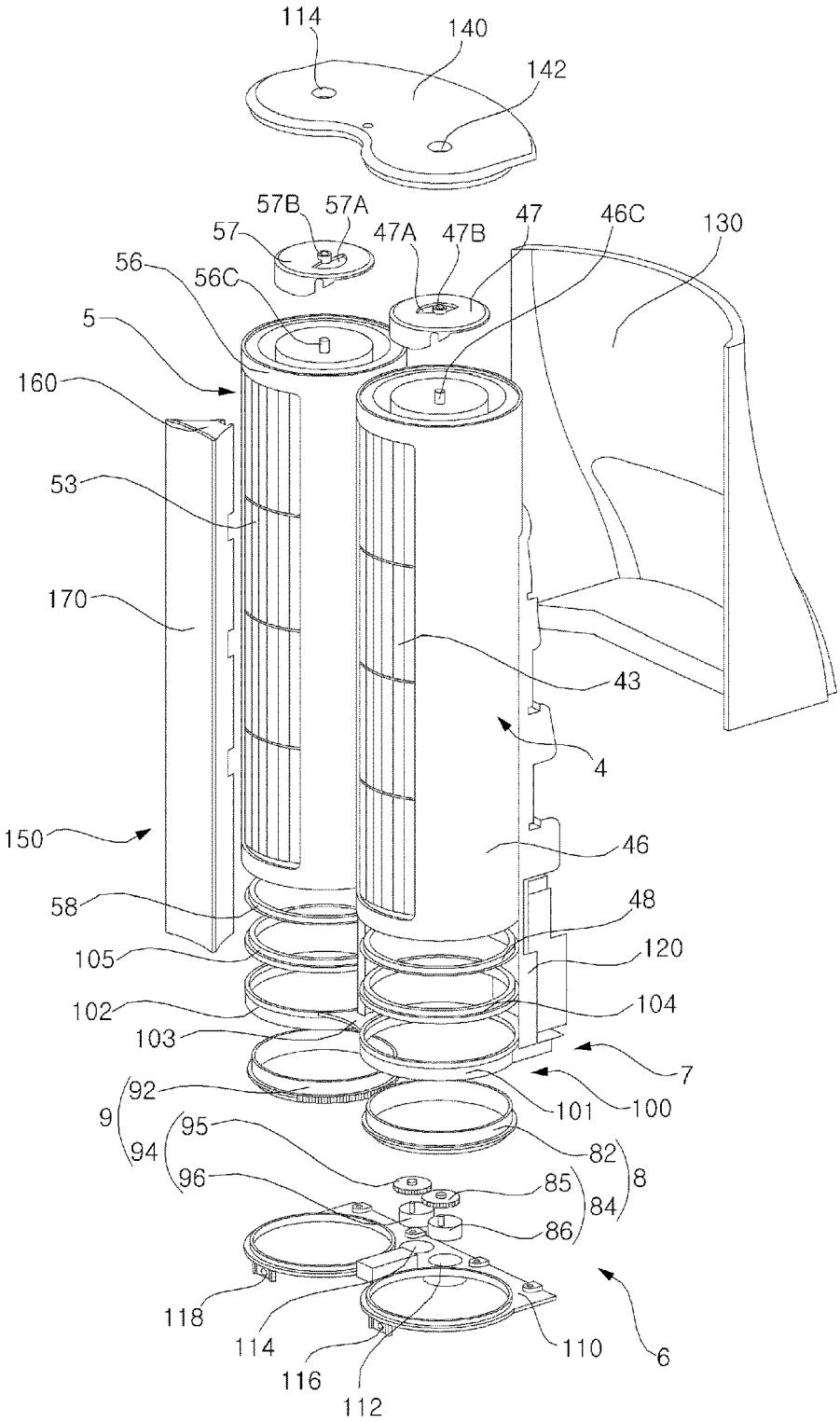
FIG. 6 is an exploded perspective view illustrating the air discharging unit of FIG. 1 and an air discharging unit holder.
Figure 7:
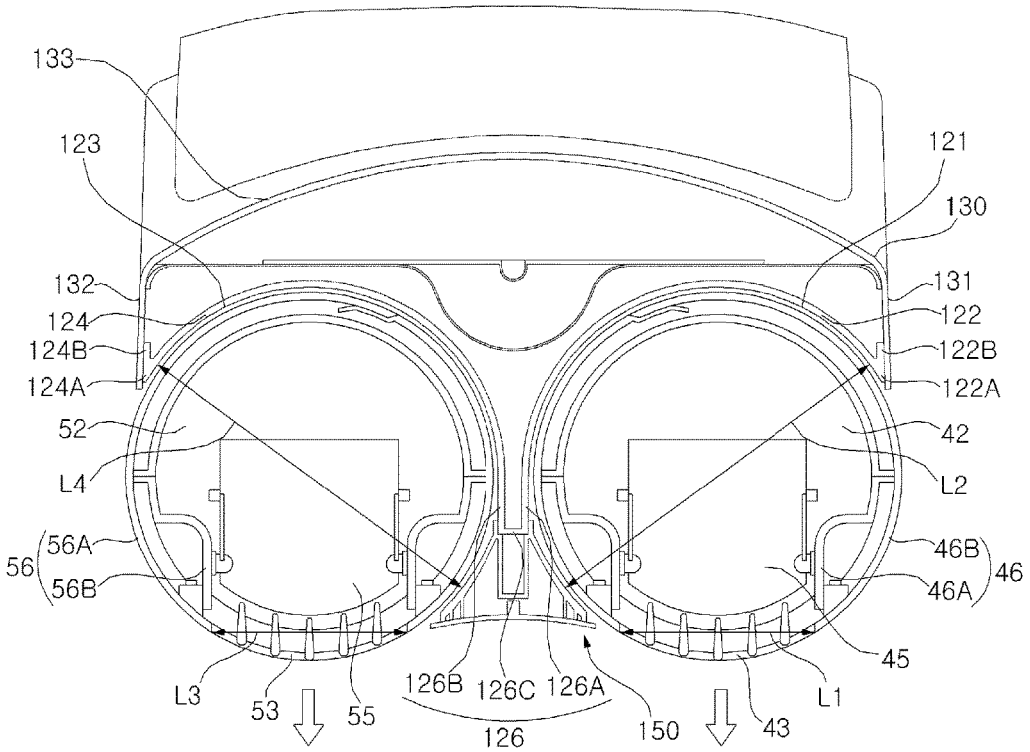
FIG. 7 is a cross-sectional view illustrating an air conditioner when a plurality of air discharging units all discharge air in a front direction, according to an embodiment of the present invention.
Figure 8:
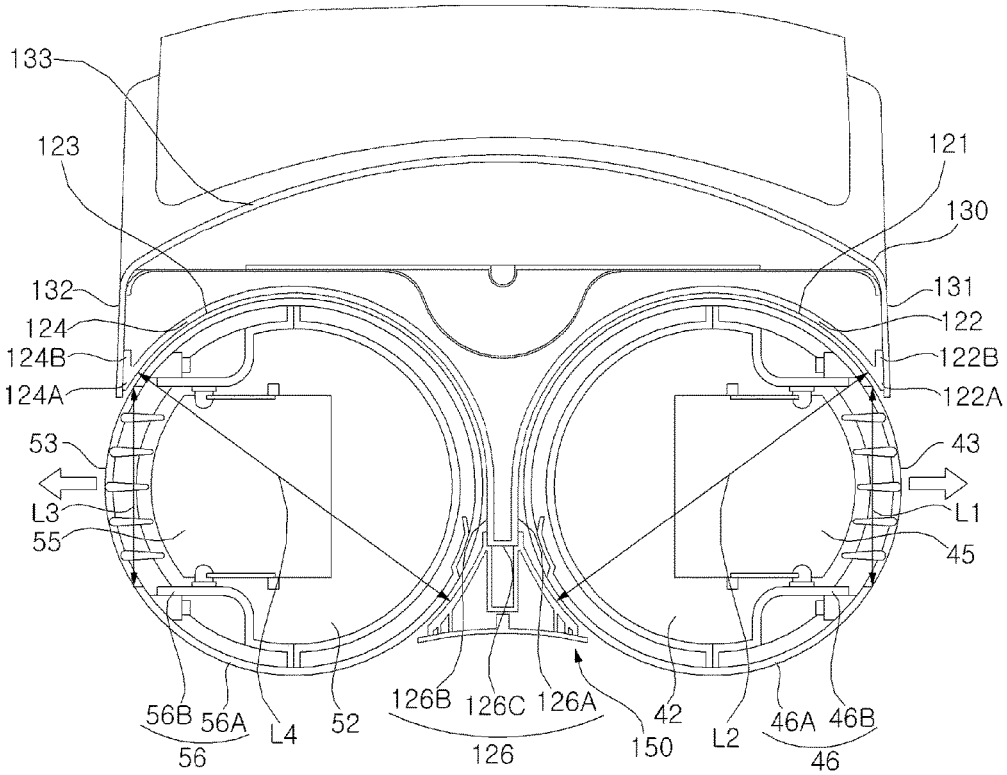
FIG. 8 is a cross-sectional view illustrating an air conditioner when a plurality of air discharging units respectively discharge air in opposite directions (in left and right directions, respectively), according to an embodiment of the present invention.
Figure 9:
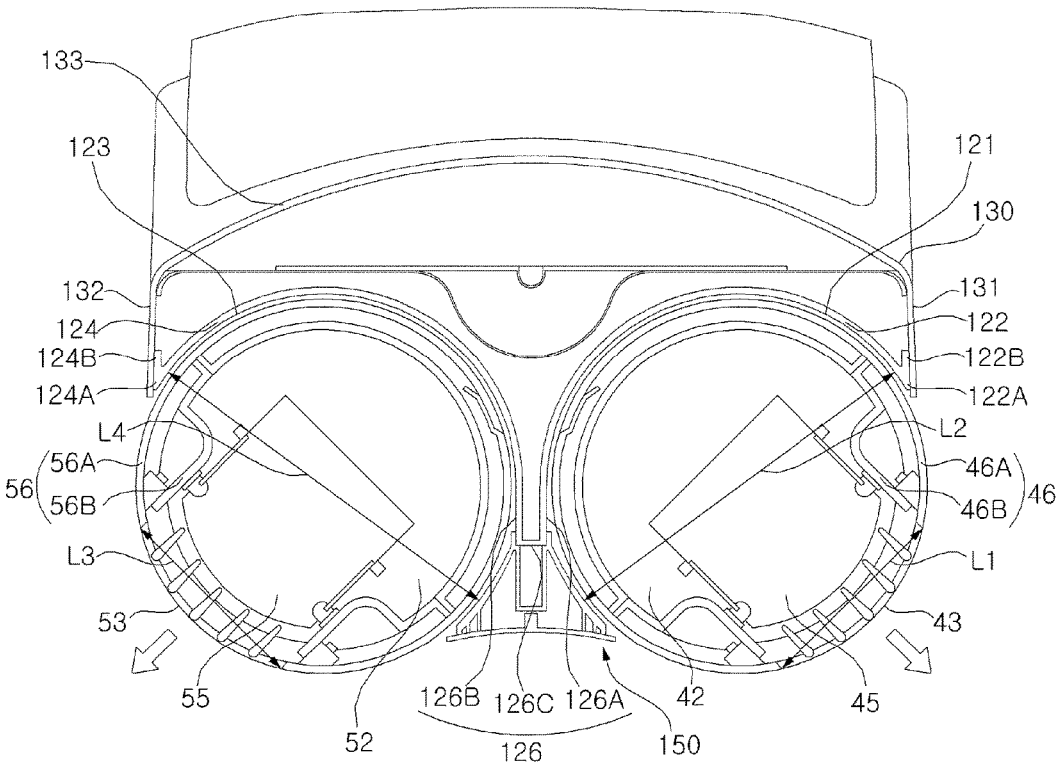
FIG. 9 is a cross-sectional view illustrating an air conditioner when a plurality of air discharging units respectively discharge air in inclined directions respectively between the front direction and a side direction and between the front direction and the other side direction, according to an embodiment of the present invention.
Figure 10:
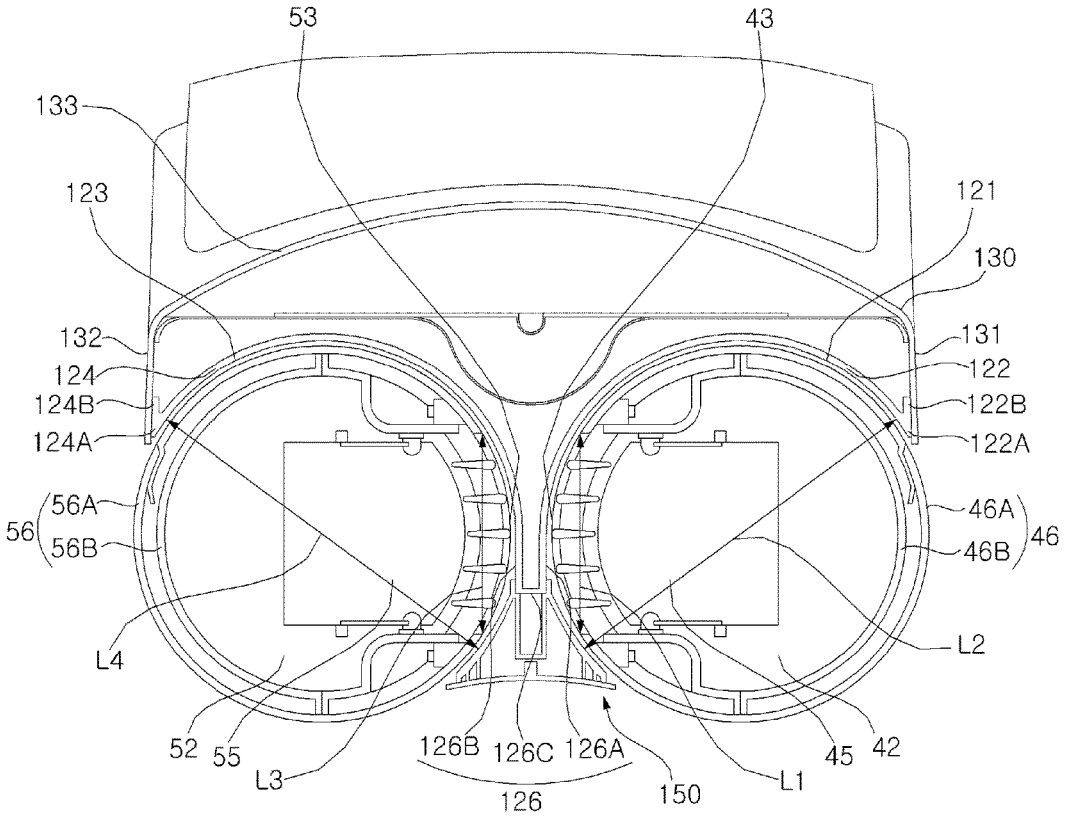
FIG. 10 is a cross-sectional view illustrating an air conditioner when the air conditioner stops its operation, according to an embodiment of the present invention.

FIG. 6 is an exploded perspective view illustrating the air discharging unit of FIG. 1 and an air discharging unit holder. FIG. 7 is a cross-sectional view illustrating an air conditioner when a plurality of air discharging units all discharge air in a front direction, according to an embodiment of the present invention. FIG. 8 is a cross-sectional view illustrating an air conditioner when a plurality of air discharging units respectively discharge air in opposite directions (in left and right directions, respectively), according to an embodiment of the present invention. FIG. 9 is a cross-sectional view illustrating an air conditioner when a plurality of air discharging units respectively discharge air in inclined directions respectively between the front direction and a side direction and between the front direction and the other side direction, according to an embodiment of the present invention. FIG. 10 is a cross-sectional view illustrating an air conditioner when the air conditioner stops its operation, according to an embodiment of the present invention.

A first air discharging unit 4 may be constitute of an assembly of a plurality of members. The first air discharging unit 4 may include a first air discharging body 46 having a first air discharging flow path 44, a first top body 47 provided at an upper side of the first air discharging body 46, and a first lower ring 48 coupled with a lower portion of the first air discharging body 46.

The first air discharging body 46 may be shaped as a cylinder with a closed top surface and an opened bottom surface. The first air inlet 41, the first internal flow path 42, and the first air outlet 43 as shown in FIG. 3 may be formed in the first air discharging body 46, and the first air outlet 43 may be formed at a portion of the outer circumferential portion of the first air discharging body 46.

Meanwhile, the first wind direction adjusting vane 45 as shown in FIG. 3 may be rotatably disposed in the first air discharging body 46. The first air discharging body 46 may include a first wind direction adjusting motor (not shown) for generating a dynamic force for rotating the first wind direction adjusting vane 45. The first wind direction adjusting motor may be connected with the wind direction adjusting vane 45 directly or via a dynamic force transferring member such as a link.

The first air discharging body 46 may have a first rotational protrusion 46C that projects forming the rotational center axis of the first air discharging unit 4.

The first air discharging body 46 may be constituted of an assembly of a plurality of members. The first air discharging body 46 may include a first outer body 46A for forming the outer appearance of the first air discharging body 46 and a first inner guide 46B provided inside the first outer body 46A.

The first outer body 46A may be overall shaped as a hollow cylinder. The first outer body 46A may be opened for its top and bottom and may have a space therein to accommodate the first inner guide 46B. The first outer body 46A may be formed so that a plurality of outer bodies each having an arc-shaped cross section are coupled into a hollow cylinder shape, and one of the plurality of outer bodies may have the first air outlet 43 where a first air discharging grill is formed.

The first inner guide 46B may be shaped as a hollow bucket with an opened bottom surface and a closed top surface. The first air inlet 41 may be formed at a lower portion of the first inner guide 46B, and the first internal flow path 42 may be formed inside the first inner guide 46B. The first wind direction adjusting vane 45 may be rotatably connected with the first inner guide 46B.

The first top body 47 may be an electric wire guide for guiding a first electric wire (not shown) connected to the first wind direction adjusting motor (not shown), and the first top body 47 may have an electric wire through hole 47A through which the first electric wire passes.

The first top body 47 may be press fitted into an upper portion of the first air discharging body 46 or may be mounted to the upper portion of the first air discharging body 46 by way of a screw or other connecting members.

The first top body 47 may have a first boss part 47B that projects in an upper direction to surround the first rotational protrusion 46C. The first boss part 47B, together with the first rotational protrusion 46C, may constitute the rotational center axis of the first air discharging unit 4. The first boss part 47B may be positioned between the first rotational protrusion 46C and the first axis supporting part 142 of the top cover 140 and may be supported by the first axis supporting part 142. In other words, the first air discharging unit 4 may be rotatably kept in position at the top cover 140 by the first rotational protrusion 46C and the first boss part 47B.

The first lower ring 48 may be coupled with a lower portion of the first air discharging body 46 and may be rotated along with the first air discharging body 46. The first lower ring 48 may be coupled with the first air discharging body 46 by way of a screw or other connecting members. The first lower ring 48 may have a connecting member through hole through which a screw or other connecting member passes.

The first lower ring 48 may be seated in the lower body 100 and may rub against the lower body 100. The first lower ring 48 may be formed of metal to reinforce the strength of the first air discharging body 46 while preventing the first air discharging body 46 from being worn.

The second air discharging unit 5 may have the same configuration as the first air discharging unit 4, and like the first air discharging unit 4, may be formed of an assembly of a plurality of members. The second air discharging unit 5 may include a second air discharging body 56 having a second air discharging flow path 54, a second top body 57 provided at an upper side of the second air discharging body 56, and a second lower ring 58 coupled with a lower portion of the second air discharging body 56.

Like the first air discharging body 46, the second air discharging body 56 may be shaped as a cylinder with a closed top surface and an opened bottom surface. The second air inlet 51, the second internal flow path 52, and the second air outlet 53 as shown in FIG. 4 may be formed in the second air discharging body 56, and the second air outlet 53 may be formed at a portion of the outer circumferential portion of the second air discharging body 56.

Meanwhile, the second wind direction adjusting vane 55 as shown in FIG. 4 may be rotatably disposed in the second air discharging body 56. The second air discharging body 56 may include a second wind direction adjusting motor (not shown) for generating a dynamic force for rotating the second wind direction adjusting vane 55. The second wind direction adjusting motor may be connected with the wind direction adjusting vane 55 directly or via a dynamic force transferring member such as a link.

The second air discharging body 56 may have a second rotational protrusion 56C that projects forming the rotational center axis of the second air discharging unit 5.

The second air discharging body 56 may be constituted of an assembly of a plurality of members. The second air discharging body 56 may include a second outer body 56A for forming the outer appearance of the second air discharging body 56 and a second inner guide 56A provided inside the second outer body 56B.

The second outer body 56A may be overall shaped as a hollow cylinder. The second outer body 56A may be opened for its top and bottom and may have a space therein to accommodate the second inner guide 56B. The second outer body 56A may be formed so that a plurality of outer bodies each having an arc-shaped cross section are coupled into a hollow cylinder shape, and one of the plurality of outer bodies may have the second air outlet 53 where a second air discharging grill is formed.

The second inner guide 56B may be shaped as a hollow bucket with an opened bottom surface and a closed top surface. The second air inlet 51 may be formed at a lower portion of the second inner guide 56B, and the second internal flow path 52 may be formed inside the second inner guide 56B. The second wind direction adjusting vane 55 may be rotatably connected with the second inner guide 56B.

The second top body 57 may be an electric wire guide for guiding a second electric wire (not shown) connected to the second wind direction adjusting motor (not shown), and the second top body 57 may have an electric wire through hole 57A through which the second electric wire passes.

The second top body 57 may be press fitted into an upper portion of the second air discharging body 56 or may be mounted to the upper portion of the second air discharging body 56 by way of a screw or other connecting members.

The second top body 57 may have a second boss part 57B that projects in an upper direction to surround the second rotational protrusion 56C. The second boss part 57B, together with the second rotational protrusion 56C, may constitute the rotational center axis of the second air discharging unit 5. The second boss part 57B may be positioned between the second rotational protrusion 56C and the second axis supporting part 144 of the top cover 140 and may be supported by the second axis supporting part 144. In other words, the second air discharging unit 5 may be rotatably kept in position at the top cover 140 by the second rotational protrusion 56C and the second boss part 57B.

The second lower ring 58 may be coupled with a lower portion of the second air discharging body 56 and may be rotated along with the second air discharging body 56. The second lower ring 58 may be coupled with the second air discharging body 56 by way of a screw or other connecting members. The second lower ring 58 may have a connecting member through hole through which a screw or other connecting member passes.

The second lower ring 58 may be seated in the lower body 100 and may rub against the lower body 100. The second lower ring 58 may be formed of metal to reinforce the strength of the second air discharging body 56 while preventing the second air discharging body 56 from being worn.

The air conditioner may include a first air discharging unit rotating mechanism 8 for rotating the first air discharging unit 4 among the plurality of air discharging units 4 and 5 and a second air discharging unit rotating mechanism 9 for rotating the second air discharging unit 5 among the plurality of air discharging units 4 and 5. The first air discharging unit rotating mechanism 8 and the second air discharging unit rotating mechanism 9, together with the air discharging unit holder 7, may constitute the air discharging unit rotating mechanism 6.

The first air discharging unit rotating mechanism 8 may rotate the first air discharging unit 4 while keeping the rotational center axis P of the first air discharging unit 4 in position. The first air discharging unit rotating mechanism 8 may rotate the first air discharging unit 4 among the plurality of air discharging units 4 and 5 so that the air discharging flow path 44 of the first air discharging unit 4 is opened to the outside, as shown in FIGS. 7 to 9. The first air discharging unit rotating mechanism 8 may rotate the first air discharging unit 4 so that at least a portion of the first air discharging unit 4 faces the center body 150 when the air conditioner stops its operation as shown in FIG. 10.

The second air discharging unit rotating mechanism 9 may rotate the second air discharging unit 5 while keeping the rotational center axis Q of the second air discharging unit 5 in position. The second air discharging unit rotating mechanism 9 may rotate the second air discharging unit 5 among the plurality of second air discharging units 4 and 5 so that the air discharging flow path 54 of the second air discharging unit 5 is opened to the outside, as shown in FIGS. 7 to 9. The second air discharging unit rotating mechanism 9 may rotate the second air discharging unit 5 so that at least a portion of the second air discharging unit 5 faces the center body 150 when the air conditioner stops its operation as shown in FIG. 10.

The air discharging unit rotating mechanism 6 may include a first gear 82 disposed at one of the plurality of air discharging units 4 and 5 and a first gear rotating mechanism 84 for rotating the first gear 82. The first gear 82 and the first gear rotating mechanism 84 may form the first air discharging unit rotating mechanism 8. The first gear rotating mechanism 84 may include a first driving gear 85 engaged with the first gear 82 and a first motor 86 for rotating the first driving gear 85.

The first gear 82 may be a first slave gear that is rotated by the first driving gear 85. The first gear 82 may have a ring-shaped body. The ring-shaped body may have, on its outer periphery, gear teeth engaged with the first driving gear 85. The ring-shaped body may be coupled with at least one of the first lower ring 48 and the first air discharging body 46 of the first air discharging unit 4 by way of a screw or other connecting member. The ring-shaped body may have a connecting member through hole through which a screw or other connecting member passes.

The first driving gear 85 may be formed to be smaller in size than the first gear 82. The first driving gear 85 may be positioned adjacent to the first gear 82, and the first driving gear 85 may rotate the first gear 82 at a position adjacent to the first gear 82.

The first motor 86 may be provided to rotate the first air discharging unit 4 and may be installed at the lower cover 110.

The air discharging unit rotating mechanism 6 may include a second gear 92 disposed at the other of the plurality of air discharging units 4 and 5 and a second gear rotating mechanism 94 for rotating the second gear 92. The second gear 92 and the second gear rotating mechanism 94 may form the second air discharging unit rotating mechanism 9. The second gear rotating mechanism 94 may include a second driving gear 95 engaged with the second gear 92 and a second motor 96 for rotating the second driving gear 95.

The second gear 92 may be a second slave gear that is rotated by the second driving gear 95. The second gear 92 may have a ring-shaped body. The ring-shaped body may have, on its outer periphery, gear teeth engaged with the second driving gear 95. The ring-shaped body may be coupled with at least one of the second lower ring 58 and the second air discharging body 56 of the second air discharging unit 5 by way of a screw or other connecting member. The ring-shaped body may have a connecting member through hole through which a screw or other connecting member passes.

The second driving gear 95 may be formed to be smaller in size than the second gear 92. The second driving gear 95 may be positioned adjacent to the second gear 92, and the second driving gear 95 may rotate the second gear 92 at a position adjacent to the second gear 92.

The second motor 96 may be provided to rotate the second air discharging unit 5 and may be installed at the lower cover 110.

The lower body 100 may be installed to be positioned at a lower side of the plurality of air discharging units 4 and 5. The lower body 100 may be formed of a single member or an assembly of a plurality of members.

The lower body 100 may include a ring-shaped first air discharging unit supporting part 101 having a first circular through hole, a ring-shaped second air discharging unit supporting part 102 having a second circular through hole, and a lower plate part 103 connecting the first air discharging unit supporting part 101 with the second air discharging unit supporting part 102. The lower plate part 103 may be integrally formed with the first air discharging unit supporting part 101 and the second air discharging unit supporting part 102. The lower plate part 103 may be positioned at a space between the first air discharging unit supporting part 101 and the second air discharging unit supporting part 102, at a rear side of the first air discharging unit supporting part 101, and at a rear side of the second air discharging unit supporting part 102.

The lower body 100, if constituted of an assembly of a plurality of members, may include a first fixing ring 104 disposed in the first air discharging unit supporting part 101 to rub against the first lower ring 48 and a second fixing ring 105 disposed in the second air discharging unit supporting part 102 to rub against the second lower ring 58.

The first fixing ring 104 may be formed of metal like the first lower ring 48. The first lower ring 48 may be seated in the first fixing ring 104.

The second fixing ring 105 may be formed of metal like the second lower ring 58. The second lower ring 58 may be seated in the second fixing ring 105.

The first fixing ring 104 and the second fixing ring 105, together with the first air discharging unit supporting part 101, the second air discharging unit supporting part 102, and the lower plate part 103, may form the lower body 100.

The lower cover 110 may have a first gear rotating mechanism mounting part 112 where the first gear rotating mechanism 84 is mounted and a second gear rotating mechanism mounting part 114 where the second gear rotating mechanism 94 is mounted. The lower cover 110 may include a plurality of couplers 116 and 118 coupled with the blower 2.

The first gear rotating mechanism mounting part 112 may be a first motor accommodating part where the first motor 86 is inserted and accommodated, and the first gear rotating mechanism mounting part 112 may be shaped so that its top surface is opened while its side outer circumferential surface and bottom surface are closed. The first gear rotating mechanism mounting part 112 may be shaped to project downwards from a side of the lower cover 110.

The second gear rotating mechanism mounting part 114 may be a second motor accommodating part where the second motor 96 is inserted and accommodated, and the second gear rotating mechanism mounting part 114 may be shaped so that its top surface is opened while its side outer circumferential surface and bottom surface are closed. The second gear rotating mechanism mounting part 114 may be shaped to project downwards from the other side of the lower cover 110. The second gear rotating mechanism mounting part 114 may be spaced apart from the first gear rotating mechanism mounting part 112.

The lower cover 110 may be seated in the blower 2 as shown in FIG. 1, and the load from the plurality of air discharging units 4 and 5 and the air discharging unit rotating mechanism 6 may be exerted to the blower 2.

The lower cover 110 may be coupled with at least one of the first air discharging part 22 and the second air discharging part 24 of the blower 2 shown in FIG. 1. The plurality of couplers 116 and 118 may include a first coupler 116 coupled to an upper portion of the first air discharging part 22 of the blower 2 shown in FIG. 1, by way of a screw or other connecting member and a second coupler 118 coupled to an upper portion of the second air discharging part 24 of the blower 2 by way of a screw or other connecting member. The lower cover 110 may be coupled with the blower 2 at multiple points. In other words, the air discharging unit holder 7 may be coupled with the blower 2 through the lower cover 110.

The rear body 120 may be integrally formed with the lower plate part 103 of the lower body 100 to project therefrom. The rear body 120 may be stereoscopically formed to protect the plurality of air discharging units 4 and 5. The side circumferential portion of each air discharging unit 4 and 5 may be partially surrounded by the rear body 120, and the rear body 120 may protect the plurality of air discharging units 4 and 5 by partially surrounding the side circumferential portion of each air discharging unit 4 and 5.

The rear body 120 may include a first accommodating part 122 that is recessed from a surface 121 facing the first air discharging unit 4 among the plurality of air discharging units 4 and 5 to accommodate the first air discharging unit 4 and a second accommodating part 124 that is recessed from a surface 123 facing the second air discharging unit 5 among the plurality of air discharging units 4 and 5 to accommodate the second air discharging unit 5.

The first accommodating part 122 may have the recessed surface 121 facing the first air discharging unit 4 among the plurality of air discharging units 4 and 5 to rotatably accommodate the first air discharging unit 4.

The first accommodating part 122 may have a rounded shape to partially surround the outer periphery of the first air discharging unit 4, and the first accommodating part 122 may be larger in size than the first air discharging unit 4. The first accommodating part 122 may have an arc-shaped cross section and may partially surround the first air discharging unit 4. A portion of the first air discharging unit 4 may be inserted and accommodated into the recessed portion of the first accommodating part 122, and a portion of the side circumferential portion of the first air discharging unit 4 may be surrounded by the first accommodating part 122. The first accommodating part 122 may protect a portion of the side circumferential portion of the first air discharging unit 4 that faces the first accommodating part 122.

The second accommodating part 124 may have the recessed surface 123 facing the second air discharging unit 5 among the plurality of air discharging units 4 and 5 to rotatably accommodate the second air discharging unit 5.

The second accommodating part 124 may be formed symmetrical with the first accommodating part 122. The second accommodating part 124 may have a rounded shape to partially surround the outer periphery of the second air discharging unit 5, and the second accommodating part 124 may be larger in size than the second air discharging unit 5. The second accommodating part 124 may have an arc-shaped cross section and may partially surround the second air discharging unit 5. A portion of the second air discharging unit 5 may be inserted and accommodated into the recessed portion of the second accommodating part 124, and a portion of the side circumferential portion of the second air discharging unit 5 may be surrounded by the second accommodating part 124. The second accommodating part 124 may protect a portion of the side circumferential portion of the second air discharging unit 5 that faces the second accommodating part 124.

The rear body 120 may include a left plate 122B and a right plate 124B. The left plate 122B may be projected backward from a left side end 122A of the first accommodating part 122. The right plate 124B may be projected backward from a right side end 124A of the second accommodating part 124.

The left-right width L1 of a first air outlet 43 may be smaller than the width L2 between the left side end 122A of the first accommodating part 122 and the center body 150. As positioned closer to the left side end 122A of the first accommodating part 122, the first air outlet 43 may allow air to be discharged substantially in a left direction, and as positioned closer to the center body 150, the first air outlet 43 may allow air to be discharged substantially in a front direction.

The left-right width L3 of a second air outlet 53 may be smaller than the width L4 between the right side end 124A of the second accommodating part 124 and the center body 150. As positioned closer to the right side end 124B of the second accommodating part 124, the second air outlet 53 may allow air to be discharged substantially in a right direction, and as positioned closer to the center body 150, the second air outlet 53 may allow air to be discharged substantially in a front direction.

The rear body 120 may have a center body coupler 126 projecting in a front direction, wherein the center body 150 is coupled to the center body coupler 126. The center body coupler 126 may project between the plurality of air discharging units 4 and 5. The center body coupler 126 may be formed by a portion of the first accommodating part 122 and a portion of the second accommodating part 124. The center body coupler 126 may include a first side portion 126A positioned between the air discharging units 4 and 5 of the first accommodating part 122 and a second side portion 126B positioned between the air discharging units 4 and 5 of the second accommodating part 124. The center body coupler 126 may further include a front plate part 126C connecting an end of the first side portion 126A with an end of the second side portion 126B. The center body coupler 126 may be shaped so that its left and right side surfaces are opened and its rear surface opened.

The center body coupler 126 and the center body 150 may partition, left and right, an upper side of the lower body 100. When the center body 150 is coupled to the center body coupler 126, the center body 150 and the center body coupler 126 may partition, left and right, the space between the air discharging units 4 and 5.

The rear cover 130 may include side plates 131 and 132 covering the side surfaces of the rear body 120. The side plate 131 may include a left side cover plate 131 covering the left side plate 122B of the rear body 120 and a right side cover plate 132 covering the right side plate 124B of the rear body 120. The rear cover 130 may include a connecting cover plate 133 connecting the left side cover plate 131 with the right side cover plate 132.

The top cover 140 may be partially positioned over the space between the air discharging units 4 and 5. The top cover 140 may prevent dust or other foreign materials from flowing into the space between the air discharging units 4 and 5. The top cover 140 may cover the space between the center body 150 and the center body coupler 126. The space between the center body 150 and the center body coupler 126 may prevent inflow of dust or other foreign materials without viewed from above the air conditioner. The top cover 140 may be coupled with at least one of the center body 150 and the rear body 120 by way of a connecting member such as a screw or a hooking member such as a hook.

The first axis supporting part 142 and the second axis supporting part 144 of the top cover 140 may be spaced apart from each other in left and right directions.

Figure 11:
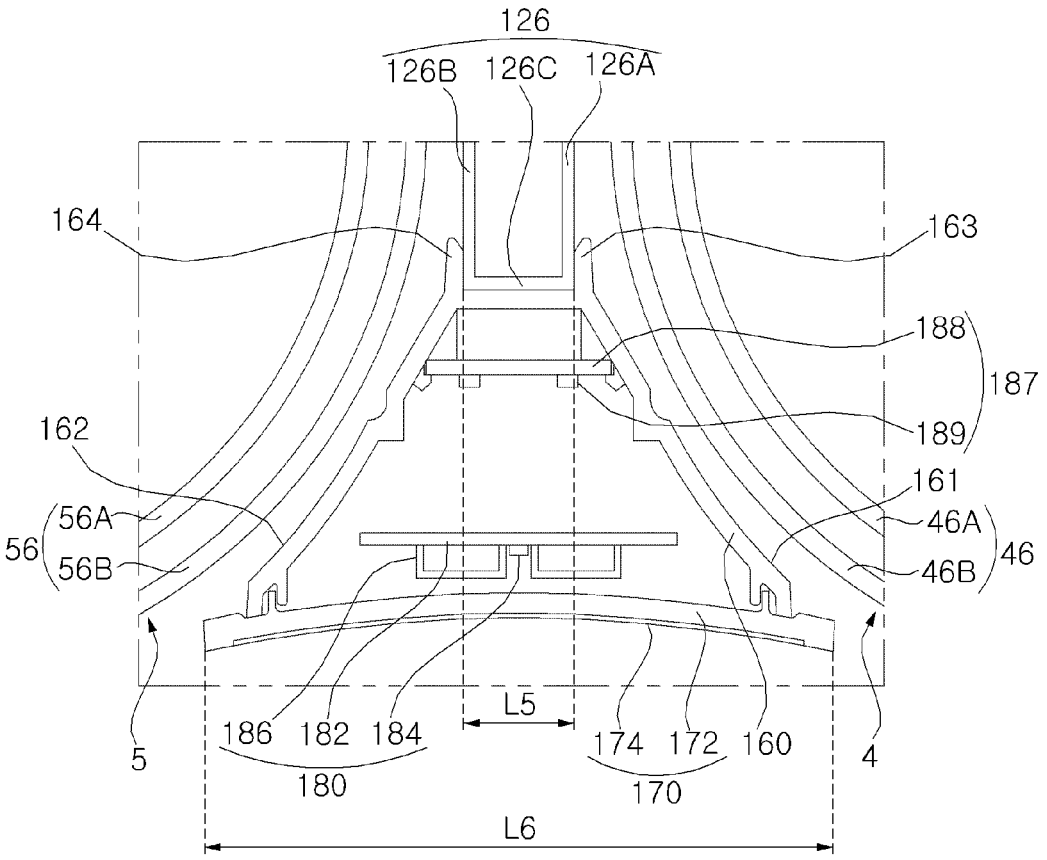
FIG. 11 is an expanded cross-sectional view illustrating a center body of an air conditioner according to an embodiment of the present invention.

FIG. 11 is an expanded cross-sectional view illustrating a center body of an air conditioner according to an embodiment of the present invention.

The center body 150 may be formed of an assembly of a plurality of members. The center body 150 is not limited in function as shielding the space between the air discharging units 4 and 5. The center body 150 may function as a control panel for manipulating the air conditioner or as a display displaying information on the air conditioner. The center body 150 may play a role as a display-cum-control panel. Hereinafter, the center body 150 is referred to as a display for ease of description.

The center body 150 may include a center case 160, a center cover 170 disposed before the center case 160, and a PCB assembly 180 installed in the center case 160.

A left side surface 161 of the center case 160 may face one 4 of the plurality of air discharging units 4 and 5, and a right side surface 162 of the center case 160 may face the other 5 of the plurality of air discharging units 4 and 5. A front surface of the center case 160 may be opened.

The center case 160 may be coupled to the center body coupler 126. The left-right width of the center case 160 may increase in the front direction thereof. The center case 160 may include a pair of ribs 163 and 164 for fitting the center body coupler 126 thereinto. The pair of ribs 163 and 164, each, may project backward from the rear plate part of the center case 160. The center body coupler 126 may be partially inserted into a space between the pair of ribs 163 and 164 and fitted into the pair of ribs 163 and 164.

The center case 160 may include a rear plate part, a left side plate part formed at a left side of the rear plate part, a right side plate part formed at a right side of the rear plate part, a top plate part formed at a top of the rear plate part, and a bottom plate part formed at a bottom of the rear plate part. The left side plate part and the right side plate part may be formed so that the distance therebetween increases in a front direction thereof.

The center case 160 may be formed of a transparent or translucent material. The center case 160 may further include a light diffusing part that may diffuse light.

The center cover 170 may be larger in size than the center case 160. The center cover 170 may cover the opened front surface of the center case 160. The center cover 170 may include a front body 172 coupled to the center case 160 and a front cover 174 disposed at a front surface of the front cover 172.

The front body 172 may have a light transmittance hole through which light from the PCB assembly 180 passes.

The front cover 174 may function as a display window displaying information regarding the air conditioner, and the center body 150 may function as a display. The front cover 174 may operate as a touch input unit where the user touches to manipulate the air conditioner. The center body 150 may function as a control panel.

The left-right width L6 of the center cover 170 may be larger than the left-right width L5 of an end of the center body coupler 126.

The PCB assembly 180 may emit light to the center cover 170. The PCB assembly 180 may include a PCB 182 coupled to the center case 160 by way of a connecting member such as a screw and at least one LED 184 mounted on the PCB 182. At least one LED 184 may be mounted on a front surface of the PCB 182 and the LED 184 may radiate light to a rear surface of the PCB cover 170. The PCB assembly 180 may further include a light guide 186 guiding light from the LED 184 to the PCB cover 170. The PCB assembly 180 may include a touch switch that switches on/off when contacted by the front cover 174. The touch switch may be mounted in the PCB 182 so that its end comes in contact with the center cover 170.

The center body 150 may further include an illuminating apparatus 187 that is installed inside the center case 160 to radiate light to the center case 160. The illuminating apparatus 187 may include a second PCB 188 installed in the center case 160 and at least one second LED 189 mounted on the second PCB 188.

Meanwhile, the air conditioner may include a controller for controlling the blower 2, the first air discharging unit rotating mechanism 8, and the second air discharging unit rotating mechanism 9.

The controller may control the first fan motor 26 and the second fan motor 28 when controlling the blower 2. The controller, when the air conditioner operates, may actuate both the first fan motor 26 and the second fan motor 28, and when the air conditioner stops operation, may stop both the first fan motor 26 and the second fan motor 28. The controller, when controlling the blower 2, may actuate only one of the first fan motor 26 and the second fan motor 28 while stopping the other of the fan motors 26 and 28. When controlling the blower 2, the controller may control the first fan motor 26 and the second fan motor 28 so that the first fan motor 26 and the second fan motor 28 have different speeds.

The controller may control the first air discharging unit rotating mechanism 8 and the second air discharging unit rotating mechanism 9 in an open air outlet mode or in a closed air outlet mode.

The open air outlet mode may refer to a mode in which the plurality of air discharging units 4 and 5 rotate so that the air outlets of the air discharging units 4 and 5 are oriented to the outside of the air conditioner.

The open air outlet mode may come in multiple air discharging modes depending on the direction in which air is discharged.

The plurality of air discharging modes may include a side surface air discharging mode in which the air discharging units 4 and 5 guide air discharge in a lateral direction thereof and a front air discharging mode in which the air discharging units 4 and 5 guide air discharge in a front direction thereof.

The plurality of air discharging modes may further include an inclined air discharging mode in which the air discharging units 4 and 5 discharge air in an inclined direction between the front and side thereof. The inclined air discharging mode may come in multiple modes that have different rotational angles with respect to the front air discharging mode. For example, the inclined air discharging mode may come in multiple modes including, e.g., a mode in which the air discharging units are rotated a predetermined angle (e.g., 10 degrees or 20 degrees) further than in the front air discharging mode.

The open air outlet mode may come in swing mode and non-swing mode depending on whether the air discharging units 4 and 5, each, alternately rotates. The swing mode may be a mode in which the air discharging units 4 and 5 discharge air while rotating in a swing manner, and the non-swing mode may be a mode in which the air discharging units 4 and 5 stop swing rotation while discharging air in a single direction along which their air outlets are oriented.

Meanwhile, the closed air outlet mode may refer to a mode in which at least part of the air outlets of the air discharging units 4 and 5 may be positioned facing a side surface of the center body 150, and the air outlets of the air discharging units 4 and 5 are not exposed to the outside but hidden. When the air conditioner stops operation, the first air discharging unit rotating mechanism 8 and the second air discharging unit rotating mechanism 9, each, may be controlled in the closed air outlet mode.

The controller, when the air conditioner operates, may actuate the first wind direction adjusting motor installed in the first air discharging unit 4 and the second wind direction adjusting motor installed in the second air discharging unit 5.

The controller may control the center body 150. The controller may control the PCB assembly 180 of the center body 150. The controller may receive various commands on the air conditioner through the center cover 170 of the center body 150 and may output signals to the PCB assembly 180 to display various pieces of information regarding the air conditioner through the center cover 170. The controller may control the illuminating apparatus 187 of the center body 150.

Now described is an operation of the present invention configured as above.

First, when the air conditioner operates, the first air discharging unit rotating mechanism 8 may rotate the first air discharging unit 4 to the position where the first air outlet 43 is oriented to the outside, and the second air discharging unit rotating mechanism 9 may rotate the second air discharging unit 5 to the position where the second air outlet 53 is oriented to the outside.

When the air conditioner operates, the first air discharging unit rotating mechanism 8 may rotate the first air discharging unit 4 so that the first air outlet 43 is exposed to the outside, and the first air discharging unit 4 may be positioned so that the first air outlet 43 faces the front thereof as shown in FIG. 7, the left side thereof as shown in FIG. 8, and the front and left side thereof as shown in FIG. 9.

When the air conditioner operates, the second air discharging unit rotating mechanism 9 may rotate the second air discharging unit 5 so that the second air outlet 53 is exposed to the outside, and the second air discharging unit 5 may be positioned so that the second air outlet 53 faces the front thereof as shown in FIG. 7, the left side thereof as shown in FIG. 8, and the front and right side thereof as shown in FIG. 9.

Meanwhile, when the air conditioner stops, the first air discharging unit rotating mechanism 8 may rotate the first air discharging unit 4 to the position where the first air outlet 43 faces the left side surface of the center body 150 as shown in FIG. 10, and the second air discharging unit rotating mechanism 9 may rotate the second air discharging unit 5 to the position where the second air outlet 53 faces the right side surface of the center body 150 as shown in FIG. 10. In such case, the first air outlet 43 may be closed by the center body 150, preventing inflow of foreign materials therethrough, and the second air outlet 53 may be closed by the center body 150, preventing inflow of foreign materials therethrough.

The present invention is not limited to the above embodiments, and various changes may be made thereto without departing from the technical category to which the present invention belongs.

What is claimed is:

1. An air conditioner, comprising:

a blower that suctions and blows;

a plurality of cylindrical air discharging units, the plurality of cylindrical air discharging units respectively having rotational center axes parallel with each other, wherein each of the cylindrical discharging units includes an air inlet through which the air blown by the blower is introduced therein, an internal flow path through which the introduced air passes, and an air outlet through which the passed air is discharged to an outside of the air conditioner; and an air discharging unit rotating mechanism that rotates each of the plurality of air discharging units, with the respective rotational center axes of the air discharging units kept in position, wherein the air discharging unit rotating mechanism includes:

a first gear disposed in any one of the plurality of air discharging units;

a first gear rotating mechanism that rotates the first gear;

a second gear disposed in another of the plurality of air discharging units; and a second gear mechanism that rotates the second gear.

2. The air conditioner of claim 1, wherein the air discharging unit rotating mechanism includes:

a lower body that rotatably supports a lower portion of each of the plurality of air discharging units; and a rear body disposed perpendicular to the lower body and that rotatably accommodates the plurality of air discharging units.

3. The air conditioner of claim 2, wherein the rear body includes:

a first accommodating part having a recessed surface facing a first air discharging unit among the plurality of air discharging units to rotatably accommodate the first air discharging unit; and a second accommodating part having a recessed surface facing a second air discharging unit among the plurality of air discharging units to rotatably accommodate the second air discharging unit.

4. The air conditioner of claim 2, wherein the air discharging unit rotating mechanism includes a top cover coupled to the rear body and positioned at an upper side of the plurality of air discharging units, wherein the top cover includes an axis support that rotatably supporting the rotational center axes of the plurality of air discharging units.

5. The air conditioner of claim 1, further comprising a center body that extends lengthwise in a vertical direction between the plurality of air discharging units to cover a gap between the plurality of air discharging units.

6. The air conditioner of claim 5, wherein the air discharging unit rotating mechanism includes:

a first air discharging unit rotating mechanism that rotates the first air discharging unit among the plurality of air discharging units so that the air discharging flow path of the first air discharging unit is open to an outside when the air conditioner operates and rotates the first air discharging unit so that at least a portion of the air discharging flow path of the first air discharging unit faces the center body when the air conditioner stops; and a second air discharging unit rotating mechanism that rotates the second air discharging unit among the plurality of air discharging units so that the air discharging flow path of the second air discharging unit is open to the outside when the air conditioner operates and rotates the second air discharging unit so that at least a portion of the air discharging flow path of the second air discharging unit faces the center body when the air conditioner stops.

7. The air conditioner of claim 5, wherein the air discharging unit rotating mechanism includes a lower body that rotatably supports a lower portion of each of the plurality of air discharging units.

8. The air conditioner of claim 7, wherein the air discharging unit rotating mechanism further includes a rear body disposed perpendicular to the lower body and that rotatably accommodates the plurality of air discharging units.

9. The air conditioner of claim 8, wherein the rear body includes:

a first accommodating part having a recessed surface facing a first air discharging unit among the plurality of air discharging units to rotatably accommodate the first air discharging unit; and a second accommodating part having a recessed surface facing a second air discharging unit among the plurality of air discharging units to rotatably accommodate the second air discharging unit.

10. The air conditioner of claim 9, wherein the first air discharging unit has a first air outlet at a periphery thereof, and the second air discharging unit has a second air outlet at a periphery thereof, wherein a lateral width of the first air outlet is smaller than a width between a first side end of the first accommodating part and the center body, and a lateral width of the second air outlet is smaller than a width between a second side end of the second accommodating part and the center body.

11. The air conditioner of claim 8, wherein the rear body includes a center body coupler projecting between the plurality of air discharging units, and wherein the center body is coupled to the center body coupler.

12. The air conditioner of claim 1, wherein the blower includes:

a first air discharge that blows the air to any one of the plurality of air discharging units; and a second air discharge that blows the air to another of the plurality of air discharging units.

13. The air conditioner of claim 1, wherein the air discharging unit rotating mechanism includes a lower body that rotatably supports a lower portion of each of the plurality of air discharging units.

14. The air conditioner of claim 13, wherein the air discharging unit rotating mechanism further includes a lower cover provided in the lower body, and wherein the lower cover includes a first gear rotating mechanism mount to which the first gear rotating mechanism is mounted and a second gear rotating mechanism mounting part where the second gear rotating mechanism is mounted.

15. The air conditioner of claim 14, wherein the lower cover includes a plurality of couplers coupled with the blower.

16. The air conditioner of claim 1, wherein the air discharging unit rotating mechanism includes:

a lower body that rotatably supports a lower portion of each of the plurality of air discharging units; and a top cover positioned at an upper side of the plurality of air discharging units and having an axis support that rotatably supports the rotational center axes of the air discharging units.

17. An air conditioner, comprising:

a blower that suctions and blows air;

a plurality of cylindrical air discharging units, wherein each of the cylindrical air discharging units includes an air inlet through which the air blown by the blower is introduced therein, an internal flow path through which the introduced air passes, and an air outlet through which the passed air is discharged to an outside of the air conditioner;

an air discharging unit holder that maintains the plurality of air discharging units in parallel with each other; and an air discharging unit rotating mechanism that rotates each of the plurality of air discharging units, with a respective rotational center axes of the air discharging units kept in position, wherein the air discharging unit rotating mechanism includes:

a first gear disposed in any one of the plurality of air discharging units;

a first gear rotating mechanism that rotates the first gear;

a second gear disposed in another of the plurality of air discharge units; and a second gear rotating mechanism that rotates the second gear.

18. The air conditioner of claim 17, wherein the air discharging unit holder includes:

a lower body that rotatably supports a lower portion of a corresponding one of the plurality of air discharging units;

a rear body formed perpendicular to the lower body and that rotatably accommodates a corresponding one of the plurality of air discharging units; and a top cover positioned at an upper side of the plurality of air discharging units and having an axis support that rotatably supports the rotational center axis of the air discharging unit.

19. The air conditioner of claim 18, wherein a center body extends lengthwise in a vertical direction between the lower body and the top cover to cover a gap between the plurality of air discharging units.

* * * * *